US006911991B2

(12) United States Patent
Marion et al.

(10) Patent No.: US 6,911,991 B2
(45) Date of Patent: Jun. 28, 2005

(54) APPARATUS AND METHOD FOR DYNAMICALLY PROGRAMMING A WINDOW ID CONFIGURATION BASED ON AN APPLICATION ENVIRONMENT

(75) Inventors: Neal Richard Marion, Georgetown, TX (US); George F. Ramsay, III, Cedar Park, TX (US); James Stanley Tesauro, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 78 days.

(21) Appl. No.: 10/394,305

(22) Filed: Mar. 20, 2003

(65) Prior Publication Data

US 2004/0183810 A1 Sep. 23, 2004

(51) Int. Cl.[7] ..... G09G 5/14
(52) U.S. Cl. ..... 345/625; 345/628
(58) Field of Search ..... 345/419, 620–629

(56) References Cited

U.S. PATENT DOCUMENTS

| | | | | | |
|---|---|---|---|---|---|
| 5,101,365 | A | * | 3/1992 | Westberg et al. | 345/807 |
| 5,440,680 | A | | 8/1995 | Ichikawa et al. | 395/158 |
| 5,831,638 | A | * | 11/1998 | West et al. | 345/539 |
| 5,838,334 | A | * | 11/1998 | Dye | 345/503 |
| 5,874,967 | A | * | 2/1999 | West et al. | 345/629 |
| 5,940,089 | A | * | 8/1999 | Dilliplane et al. | 345/553 |
| 6,157,374 | A | * | 12/2000 | West et al. | 345/539 |
| 6,529,208 | B1 | * | 3/2003 | Chun et al. | 345/629 |
| 6,529,908 | B1 | * | 3/2003 | Piett et al. | 707/10 |
| 6,573,904 | B1 | * | 6/2003 | Chun et al. | 345/629 |
| 6,628,291 | B1 | * | 9/2003 | Edrington et al. | 345/545 |
| 6,710,777 | B1 | * | 3/2004 | Chun et al. | 345/545 |
| 6,822,659 | B2 | * | 11/2004 | Marion et al. | 345/629 |
| 6,831,660 | B1 | * | 12/2004 | Kipping et al. | 345/625 |

FOREIGN PATENT DOCUMENTS

EP 0 587 342 A1 8/1993 ..... G09G/5/14

OTHER PUBLICATIONS

Akeley, K., and T. Jermoluk, "High–Performance Polygon Rendering," SIGGRAPH 88, pp 239–246.*

Foley, J., A. van Dam, S. Feiner, J. Hughes, "Computer Graphics: Principles and Practice," Addison–Wesley Publishing Company, 1996, pp 908.*

Grupp et al., "Independent Pixel Interpretation for Windowed Overlays/Underlays", IBM Technical Bulletin, vol. 38, No. 09, Sep. 1995, pp. 365–367.

U.S. Appl. No. 09/478,304, Method and Apparatus for Updating a Window Identification Buffer in a Data Processing System, filed Jan. 6, 2000, Chun et al.

* cited by examiner

*Primary Examiner*—Matthew C. Bella
*Assistant Examiner*—Alysa N Brautigam
(74) *Attorney, Agent, or Firm*—Duke W. Yee; Mark E. McBurney; Lisa L. B. Yociss

(57) ABSTRACT

The present invention provides a mechanism by which the number of bits used to identify the WIDs for each of the color buffer and the overlay buffer may be programmed into the graphics adapter based on the currently active application environment. With the apparatus and method of the present invention, a programmable WAT color size selection device is provided in a RAMDAC of the graphics adapter. This programmable WAT color size selection device may be dynamically programmed to use varying bit splits of a WID from a WID buffer to obtain different indexes into a color WAT table and an overlay WAT table. In this way, different splits of, for example, an eight bit WID may be obtained based on the setting of the programmable WAT color size selection device such that varying color and overlay capabilities are obtainable dynamically.

10 Claims, 5 Drawing Sheets

| WID COLOR BUFFER | WID OVERLAY BUFFER | SCREEN |
|---|---|---|
| 666611111111111 | 001111111222222 | 661111111222222 |
| 666611155555111 | 001111111000222 | 661111111555222 |
| 777771155555111 | 221111111000222 | 221111111555222 |
| 777771155555111 | 222222200000222 | 222222255555222 |
| 777771155555111 | 222222200000222 | 222222255555222 |
| 777771111111111 | 222222222222222 | 222222222222222 |

700

| WID | PIXEL TYPE | COLORMAP | BUFFER | GAMMA | | PIXEL TYPE | COLORMAP | TRANSPARENT |
|---|---|---|---|---|---|---|---|---|
| 0 | | | | | | 8 | 0 | 2 |
| 1 | | | | | | 8 | 2 | 2 |
| 2 | | | | | | 8 | 3 | 2 |
| 3 | | | | | | 8 | 1 | 2 |
| 4 | | | | | | 8 | 2 | 2 |
| 5 | 8 | 0 | 0 | | | 8 | 4 | 1 |
| 6 | 8 | 4 | 0 | | | 8 | 4 | 1 |
| 7 | 24 | 3 | 0 | | | 8 | 4 | 1 |
| 8 | 24 | 2 | 0 | | | 8 | 4 | 1 |
| 9 | 8 | 1 | 0 | | | 8 | 4 | 1 |
| a | 8 | 4 | 0 | | | 8 | 4 | 1 |
| b | 8 | 4 | 0 | | | 8 | 4 | 1 |
| c | 8 | 3 | 0 | | | 8 | 4 | 1 |
| d | 8 | 2 | 0 | | | 8 | 4 | 1 |
| e | 24 | 1 | 0 | | | 8 | 4 | 1 |
| f | 8 | 0 | 0 | | | 8 | 4 | 1 |

COLOR WAT OVERLAY WAT

*FIG. 7*

APPARATUS AND METHOD FOR DYNAMICALLY PROGRAMMING A WINDOW ID CONFIGURATION BASED ON AN APPLICATION ENVIRONMENT

RELATED APPLICATION

This application is related to commonly assigned U.S. patent application Ser. No. 09/478,304 entitled "Method and Apparatus for Updating a Window Identification Buffer in a Data Processing System," filed on Jan. 6, 2000 and hereby incorporated by reference.

BACKGROUND OF THE INVENTION

1. Technical Field

The present invention relates generally to an improved data processing system and in particular to a method and apparatus for displaying pixels in a data processing system. Still more particularly, the present invention provides a method and apparatus for updating a window identification buffer used to display pixels in a data processing system dynamically based on the requirements of an application environment.

2. Description of Related Art

Computer graphics concerns the synthesis or display of real or imaginary objects from computer-based models. In computer graphics systems, images are displayed on a display device to a user in two dimensional and three dimensional forms. These images are displayed using pixels. A pixel is short for a picture element. One spot in a rectilinear grid of thousands of such spots that are individually "painted" to form an image produced on the screen by a computer or on paper by a printer. A pixel is the smallest element that display or print hardware and software can manipulate in creating letters, numbers, or graphics. These pixels and information relating to these pixels are stored in a buffer. The information describing a pixel is identified using a window ID (WID). A WID is used as an index into a window attribute table (WAT). The WAT contains information describing how a pixel will be displayed on the screen. For example, a WAT identifies depth, color map, buffer, and gamma for a pixel.

Typically, the WID is drawn into a separate buffer, which is used to describe how the pixels in the frame buffer or buffers will be displayed. Some graphic systems, such as, for example, UNIX servers, use overlays to enhance the performance of three dimensional applications, which need to have data overlaid on top of a three dimensional application. These type of servers typically require a separate WID buffer for the color planes and overlays to allow for a unique pixel interpretation for each layer. That is, separate WID buffers are used so that for any given pixel location, e.g., x=10, y=10, the pixel in the overlay can have a different pixel interpretation, e.g., different color map, depth, etc., from the one in the color planes.

An example of such an overlay is shown in FIG. 1. In this example, map 100 may be displayed using pixels located in two frame buffers and a single WID buffer. Map 100 includes a set of pixels in a color frame buffer that represent states in map 100. For example, shape 102 is that of the State of Texas. The pixels for shape 102 are located in a color frame buffer, while the text "Texas" 104 is located in a overlay frame buffer. In this example, "Texas" 104 is located in a region 106 in the overlay frame buffer, while shape 102 is located in a region 108 in the color frame buffer.

In FIG. 2A, an example of data in a portion of a WID color buffer is illustrated. FIG. 2B is an example of data in a portion of a WID overlay buffer. In these two examples, each of the numbers illustrates a WID which is used as an index into a WAT to identify information used to display a pixel associated with the WID. In FIG. 2B a zero is used to indicate that the overlay is disabled.

FIG. 3 illustrates resulting WIDs that would be used to display pixels displayed on a screen. Each of the WIDs identifies what pixels and from what buffer the pixels will be retrieved for display.

Typically, an eight bit split WID may he identified in hardware in which three bits are used to identify the WID for the overlay buffer and in which five bits are used to identify the WID for the color buffer. For example, the first three bits are used as an index into an overlay WAT while the lower five bits are used as an index into a color WAT. With three bits, eight WID entries may be identified or assigned to a pixel using the WID overlay buffer. Thirty-two different WID entries may be assigned to pixels using the WID color buffer. In this manner, a WID for a color buffer may be painted without overwriting the WIDs for the overlay buffer.

Alternatively, some hardware makes use of an eight bit split WID in which four bits are used to identify the WID for the color buffer and the other four bits are used to identify the WID for the overlay buffer. As a result, such a configuration provides sixteen WIDs for both the overlay and color planes.

Thus, in known systems, either an eight bit split WID with five bits used to identify a WID for the color buffer and three bits used to identify the WID for the overlay buffer or an eight bit split WID with four bits being used to identify each of the WID for the color buffer and the overlay buffer are provided in a graphics adapter. These configurations are fixed and not changeable.

As applications become more graphically sophisticated, these two static approaches to providing WID planes are fast becoming too limiting. This is especially true for today's dynamic graphics environment where the number of WIDs required for each layer, i.e. color and overlay, can vary greatly over time. Thus, there is a need for an improved apparatus and method for providing dynamically adjustable WID splits to accommodate the dynamic graphics environments of today's computer applications.

SUMMARY OF THE INVENTION

The present invention provides a mechanism by which the number of bits used to identify the WIDs for each of the color buffer and the overlay buffer may be programmed into the graphics adapter based on the currently active application environment. With the apparatus and method of the present invention, a programmable WAT color size selection device is provided in a RAMDAC of the graphics adapter. This programmable WAT color size selection device may be dynamically programmed to use varying bit splits of a WID from a WID buffer to obtain different indexes into a color WAT table and an overlay WAT table. In this way, different splits of, for example, an 8 bit WID may be obtained based on the setting of the programmable WAT color size selection device such that varying color and overlay capabilities are obtainable dynamically.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

FIG. 2A is an example of data in a portion of a WID color buffer;

FIG. 2B is an example of data in a portion of a WID overlay buffer;

FIG. 3 illustrates resulting WIDs that would be used to display pixels displayed on a screen;

FIG. 7 is an exemplary WAT table illustrated for a color WAT and an overlay WAT in accordance with the present invention;

DETAILED DESCRIPTION OF THE PREFERRED EMBODIMENT

Figure 1:
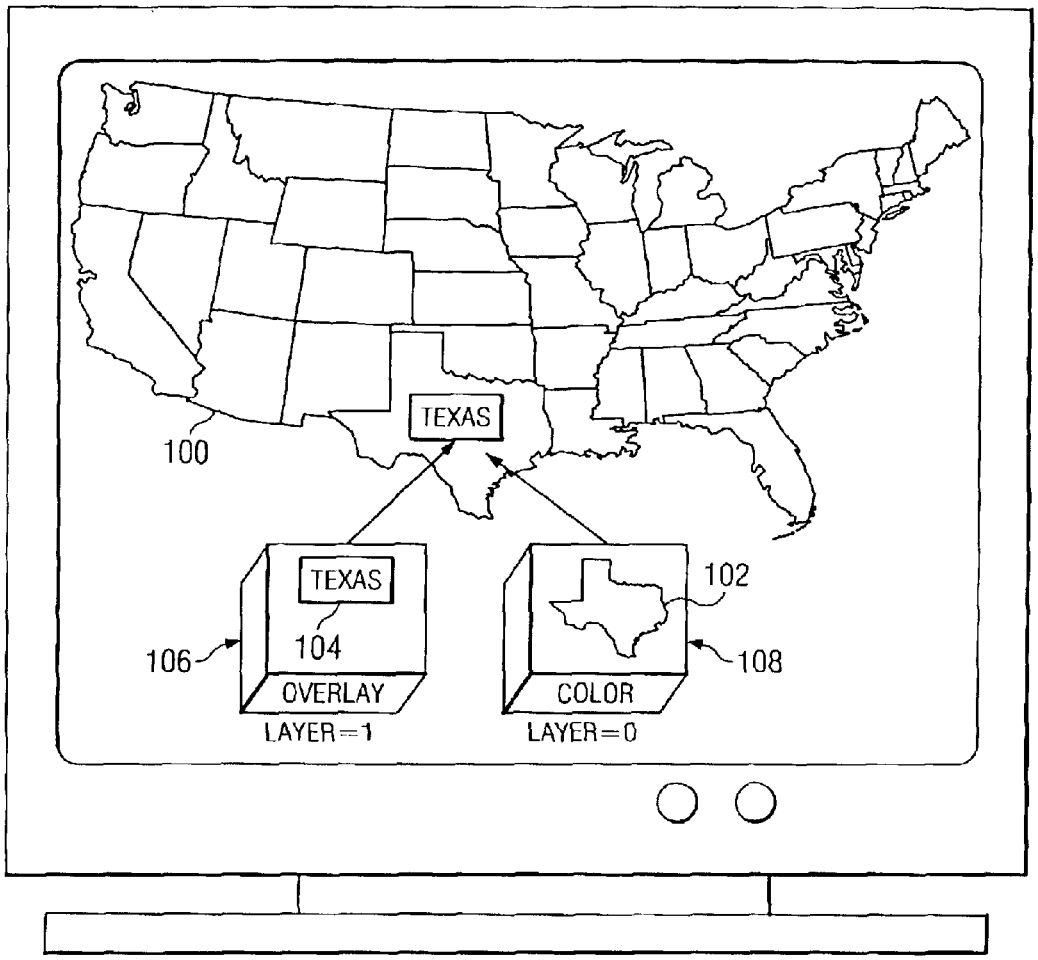
FIG. 1 is an example of data in a portion of a color buffer and an overlay buffer.
Figure 4:
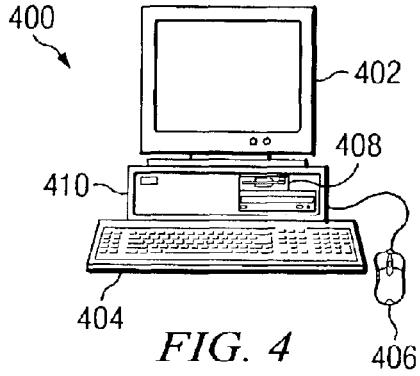
FIG. 4 is a pictorial representation of a data processing system in which the present invention may be implemented in accordance with a preferred embodiment of the present invention.

With reference now to the figures and in particular with reference to FIG. 4, a pictorial representation of a data processing system in which the present invention may be implemented is depicted in accordance with a preferred embodiment of the present invention. A computer 400 is depicted which includes a system unit 410, a video display terminal 402, a keyboard 404, storage devices 408, which may include floppy drives and other types of permanent and removable storage media, and mouse 406. Additional input devices may be included with personal computer 400. Computer 400 can be implemented using any suitable computer, such as an IBM RS/6000 computer or IntelliStation computer, which are products of International Business Machines Corporation, located in Armonk, N.Y. Although the depicted representation shows a computer, other embodiments of the present invention may be implemented in other types of data processing systems, such as a network computer. Computer 400 also preferably includes a graphical user interface that may be implemented by means of systems software residing in computer readable media in operation within computer 400.

Figure 5:
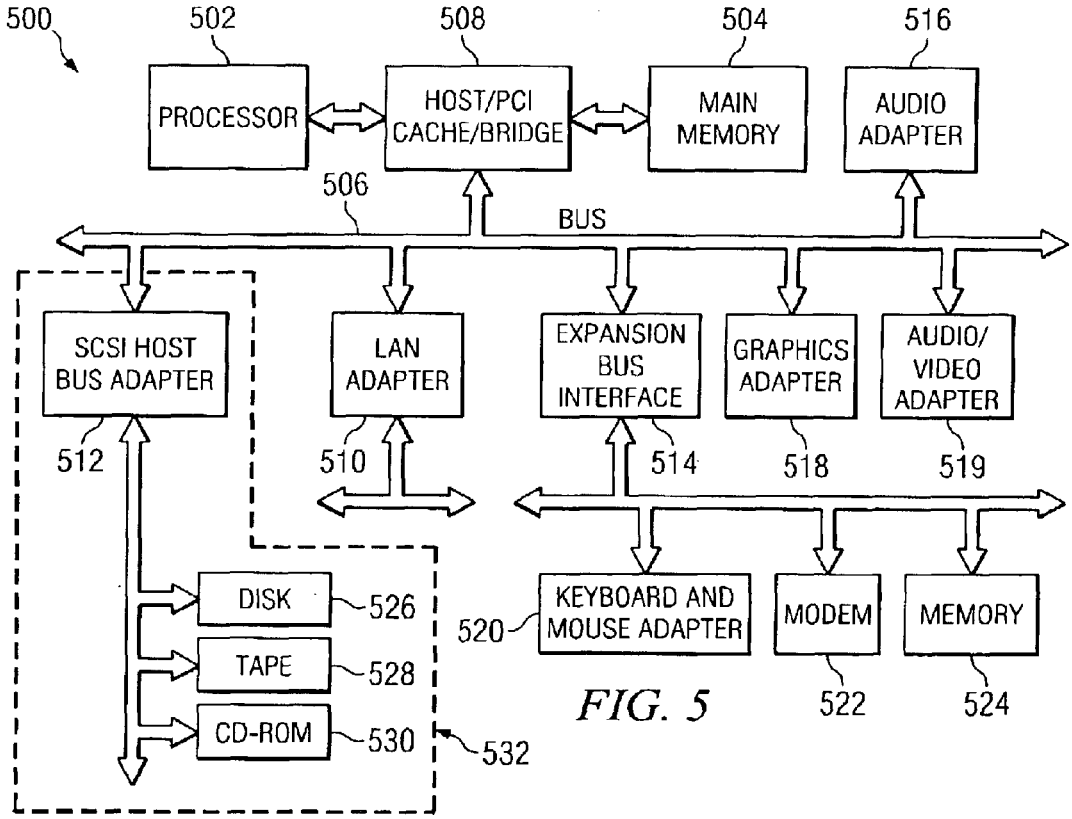
FIG. 5 is a block diagram illustrating a data processing system in which the present invention may be implemented.

With reference now to FIG. 5, a block diagram illustrates a data processing system in which the present invention may be implemented. Data processing system 500 is an example of a computer, such as computer 400 in FIG. 4, in which code or instructions implementing the processes of the present invention may be located. Data processing system 500 employs a peripheral component interconnect (PCI) local bus architecture. Although the depicted example employs a PCI bus, other bus architectures such as Accelerated Graphics Port (AGP) and Industry Standard Architecture (ISA) may be used. Processor 502 and main memory 504 are connected to PCI local bus 506 through PCI bridge 508. PCI bridge 508 also may include an integrated memory controller and cache memory for processor 502. Additional connections to PCI local bus 506 may be made through direct component interconnection or through add-in boards. In the depicted example, local area network (LAN) adapter 510, small computer system interface SCSI host bus adapter 512, and expansion bus interface 514 are connected to PCI local bus 506 by direct component connection. In contrast, audio adapter 516, graphics adapter 518, and audio/video adapter 519 are connected to PCI local bus 506 by add-in boards inserted into expansion slots. The processes of the present invention may be used to manage rendering of data by graphics adapter 518 or audio/video adapter 519.

Expansion bus interface 514 provides a connection for a keyboard and mouse adapter 520, modem 522, and additional memory 524. SCSI host bus adapter 512 provides a connection for hard disk drive 526, tape drive 528, and CD-ROM drive 530. Typical PCI local bus implementations will support three or four PCI expansion slots or add-in connectors.

An operating system runs on processor 502 and is used to coordinate and provide control of various components within data processing system 500 in FIG. 5. The operating system may be a commercially available operating system such as OS/2, which is available from International Business Machines Corporation. "OS/2" is a trademark of International Business Machines Corporation. An object oriented programming system such as Java may run in conjunction with the operating system and provides calls to the operating system from Java programs or applications executing on data processing system 500. "Java" is a trademark of Sun Microsystems, Inc. Instructions for the operating system, the object-oriented operating system, and applications or programs are located on storage devices, such as hard disk drive 526, and may be loaded into main memory 504 for execution by processor 502.

Those of ordinary skill in the art will appreciate that the hardware in FIG. 5 may vary depending on the implementation. Other internal hardware or peripheral devices, such as flash ROM (or equivalent nonvolatile memory) or optical disk drives and the like, may be used in addition to or in place of the hardware depicted in FIG. 5. Also, the processes of the present invention may be applied to a multiprocessor data processing system.

For example, data processing system 500, if optionally configured as a network computer, may not include SCSI host bus adapter 512, hard disk drive 526, tape drive 528, and CD-ROM 530, as noted by dotted line 532 in FIG. 5 denoting optional inclusion. In that case, the computer, to be properly called a client computer, must include some type of network communication interface, such as LAN adapter 510, modem 522, or the like. As another example, data processing system 500 may be a stand-alone system configured to be bootable without relying on some type of network communication interface, whether or not data processing system 500 comprises some type of network communication interface. As a further example, data processing system 500 may be a Personal Digital Assistant (PDA) device which is configured with ROM and/or flash ROM in order to provide non-volatile memory for storing operating system files and/or user-generated data.

The depicted example in FIG. 5 and above-described examples are not meant to imply architectural limitations. For example, data processing system 500 also may be a notebook computer or hand held computer in addition to taking the form of a PDA. Data processing system 500 also may be a kiosk or a Web appliance.

Figure 6:
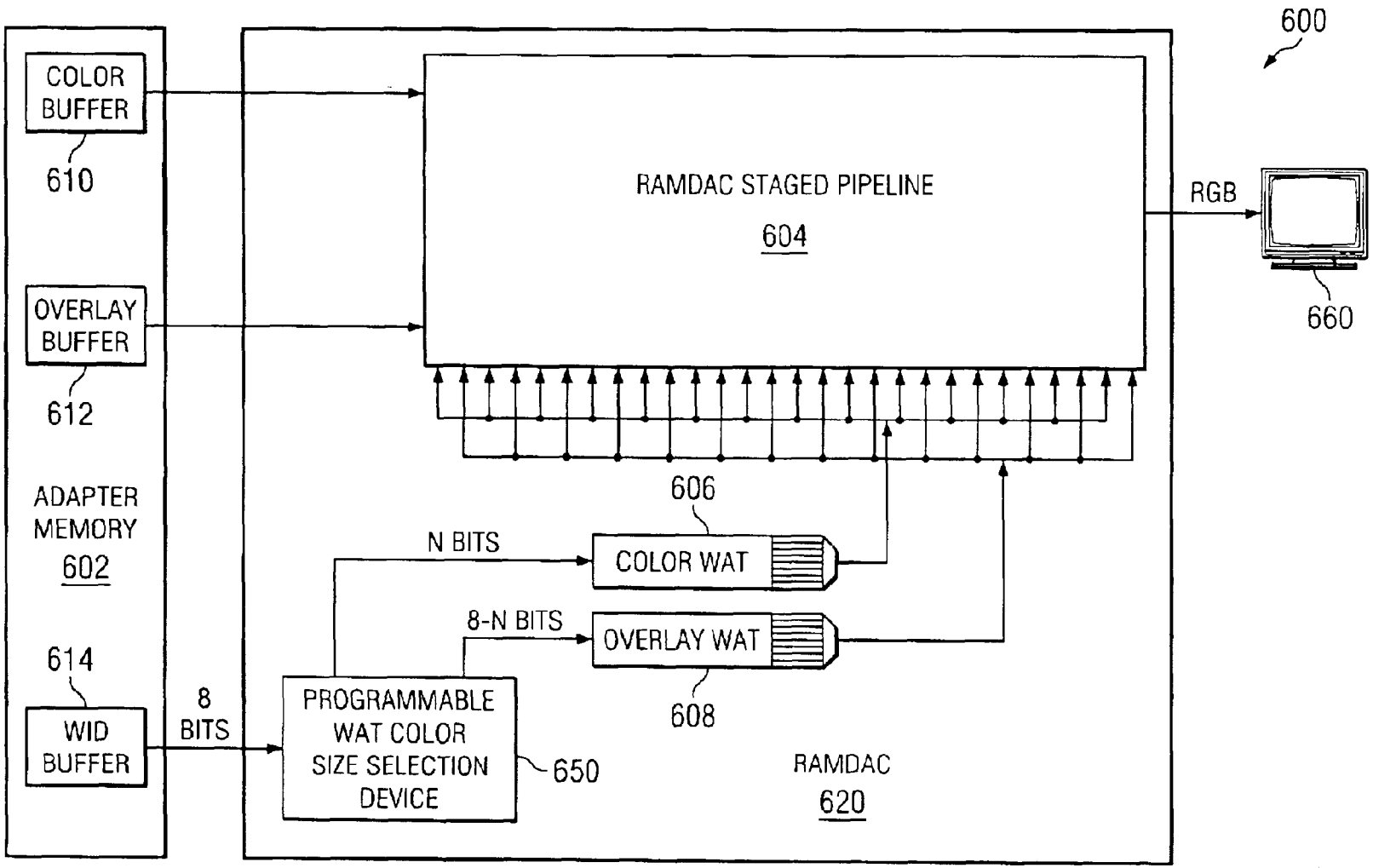
FIG. 6 is a block diagram illustrating a graphics adapter is depicted in accordance with the present invention.

Turning next to FIG. 6, a block diagram illustrating a graphics adapter is depicted in accordance with a preferred embodiment of the present invention. Graphics adapter 600 is an example of a graphics adapter, such as graphics adapter 518 in FIG. 5. Graphics adapter 600 includes an adapter memory 602 and a random access memory digital to analog converter (RAMDAC) 620. The RAMDAC 620 includes a RAMDAC staged pipeline 604, a color WAT table 606, an overlay WAT table 608, and a programmable WAT color size selection device 650. Adapter memory 602 includes a color frame buffer 610, an overlay frame buffet 612, and a WID buffer 614. The two frame buffers contain pixels, which are sent to RAMDAC staged pipeline 604 for output to a display device 660. RAMDAC staged pipeline 604 is a graphics controller chip that maintains the color palette and converts data from memory into analog signals for a display device 660.

WID buffer 614 contains WIDs that are used as an index into color WAT table 606 and overlay WAT table 608. Each of these WAT tables 606 and 608 describes how a pixel will be rendered on a display device.

The programmable WAT color size selection device 650 is used to select which bits from the WID buffer 614 are used to identify a color WAT table 606 entry and which bits from the WID buffer 614 are used to identify an overlay WAT table 608 entry. The programmable WAT color size selection device 650 is programmable by an outside entity via a data bus (not shown), such as PCI local bus 506 in FIG. 5. Based on the control data received via the data bus, a register in the WAT color size selection device 650 of the graphics adapter is set which in turn sets the number of bits used for identifying color WAT table entries and overlay WAT table entries. In this way, the split of the WID is dynamically programmable by a graphics device driver, e.g., an XServer.

That is, based on the control data received, the configuration of the programmable WAT color size selection device 650 is modified so that an identified number of bits received from the WID buffer 614 are passed along to the color WAT table 606 to thereby identify an entry in the color WAT table 606. The remaining bits from the WID buffer are passed along to the overlay WAT table 608 for identifying an overlay WAT table entry. The identified color WAT table entry and overlay WAT table entry are then output to the RAMDAC staged pipeline 604 for use with data from the color buffer 610 and overlay buffer 612 to generate a screen image on the display device 660.

The control data used to set the WID split in the programmable WAT color size selection device 650 may be generated by any outside source that is capable of interfacing with the graphics adapter 600 and selecting the WAT color size to be used. In a preferred embodiment, the WAT color size is selected based on the currently active application environment and the control data is sent to the graphics adapter 600 by graphics device driver software. Of course other mechanisms for setting the WID split may be used without departing from the spirit and scope of the present invention. Such other mechanisms may take the form of a physical switch, a separate input line upon which control signals are received from external circuitry, and the like.

For example, an application may change an attribute (new color map, swap buffers, etc.) that will require a new WID. Typically this happens when a new window is opened by an application. The new window will be assigned a shared WID if it has the same pixel interpretation as another window, i.e. same color map, buffer, depth, layer, etc., or it is assigned a new WID. It is at this time that the WID split may need to be changed based on these new attributes for the new window.

As a result, the graphics device driver software may send control data to the programmable WAT color size selection device 650 based on these new attributes for the new window to thereby program the programmable WAT color size selection device 650 to change the split of the WIDs from the WID buffer. Such splits may include, for example, 7-1 color/overlay split of the 8 bit WID, 6-2, 5-3, 4-4, and the like, splits of the 8 bit WID from the WID buffer 614.

In this way, various levels of color and overlay graphics capabilities are obtainable dynamically based on the particular active application environment currently being used by the computing system. The graphics device driver, e.g., XServer, dynamically manages the WID split based on the currently active application environment. In this way, different WID splits may be obtained for different applications as the different applications become active in the computing system.

In FIG. 7, an example of a WAT table is depicted in accordance with a preferred embodiment of the present invention. WAT table 700 contains information describing the pixel type, the color map, the buffer, and the gamma for color WATs. WAT Table 700 includes information such as pixel type, color map, and transparency for overlay WATs. WAT table 700, in this example, contains two sets of sixteen entries indexed by a WID. The pixel type in this example describes the pixel type as being an eight bit pixel color or a twenty-four bit true color. Other information that may be included may be, for example, which frame buffer will be displayed, whether the overlay is transparent, or whether the overlay is disabled. These entries may be used in color WAT table 606 and overlay WAT table 608 in FIG. 6.

In this example, only four bits are used as an index into a WAT table. Each table contains sixteen entries, which are indexed by a WID from WID buffer 614 in FIG. 6. This in contrast to an eight bit system in which the WID is split between the color WAT and the overlay WAT. The four bit WID is shared between the overlay and color WAT. So each WID entry will point to an overlay WAT and color WAT. The buffer used to display the pixel on the screen will depend on a setting of the overlay WAT for the WID entry. This setting may be, for example, an opaque overlay, transparent overlay, or overlay disabled.

As discussed previously, in known systems, either an eight bit split WID with five bits used to identify a WID for the color buffer and three bits used to identify the WID for the overlay buffer or an eight bit split WID with four bits being used to identify each of the WID for the color buffer and the overlay buffer are provided in a graphics adapter. These configurations are fixed and not changeable. That is, the graphics adapter may include only a single color WAT table and overlay WAT table that may be indexed by a fixed number of bits from a WID buffer. Thus, there is no flexibility with regard to the color and overlay capabilities of the graphics adapter.

However, modern dynamic graphics environment would benefit from a more flexible approach to a split WID such that the number of bits used to identify the WIDs for each of the color buffer and the overlay buffer is selectable. The present invention provides a mechanism by which the number of bits used to identify the WIDs for each of the color buffer and the overlay buffer may be programmed into the graphics adapter based on the currently active application environment.

In order to facilitate this programmability, the size of the color WAT table 606 and overlay WAT table 608 may be increased to accommodate the maximum number of bits that may be used to index into the tables. That is, if the maximum number of bits for a color WAT table is 7, such as in a 7-1 bit split between color and overlay WAT tables, then the number of entries in the color WAT table 606 will need to be a sufficient to cover all possible values obtainable from the 7 bit color WID. Similarly, if the maximum number of bits for an overlay WAT table is 4, such as in a 4-4 bit split between color and overlay WAT tables, then the number of entries in the overlay WAT table 608 will need to be sufficient to cover all possible values obtainable from the 4 bit overlay WID. With such a color WAT table 606 and overlay WAT table 608, even if lower numbers of bits are used than the maximum, the resulting WID will index into a particular entry of the color WAT table 606 and overlay WAT table 608.

Figure 8:
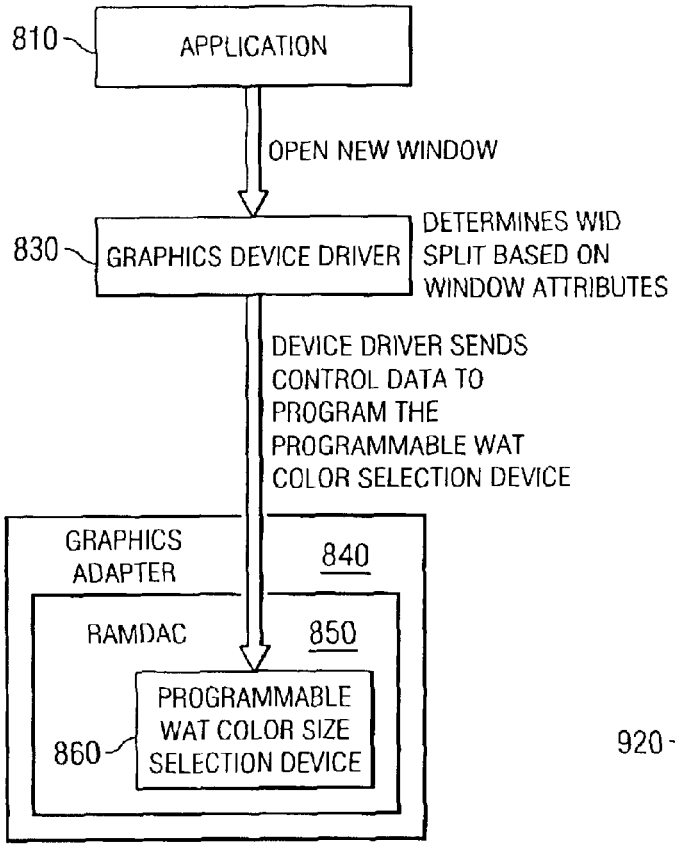
FIG. 8 is an exemplary diagram illustrating the data flow between application, device driver, and RAMDAC in order to provide a dynamically configurable WID according to the present invention.

FIG. 8 is an exemplary block diagram illustrating one exemplary embodiment for programming the programmable WAT color size selection device in accordance with the present invention. As shown in FIG. 8, an application 810 requests a window be opened in the color planes (overlays would work as well). The graphics device driver 830 (e.g., Xserver) receives the request and determines if a new WID is to be assigned to the window or if an existing WID may be utilized. If a new WID is assigned, the WID split is determined based on the attributes of the new window that is being opened by the application. Based on this determination of WID split, control data may be sent to the programmable WAT color size selection device 860 in the RAMDAC 850 of the graphics adapter 840 to thereby program the programmable WAT color size selection device 860 to provide the desired WID split.

For example, when determining the WID split, the graphics device driver may determine that there are no WIDs available for the color planes but there are plenty of WIDs available for the overlay planes. In such an instance, the WID split may be changed by taking one plane from the overlay WIDs and giving it to the color plane WIDs. This change in WID split may be realized by the graphics device driver sending control data to the programmable WAT color size selection device to thereby set the WID split such that one plane is moved from the overlay WIDs to the color plane WIDs.

Figure 9:
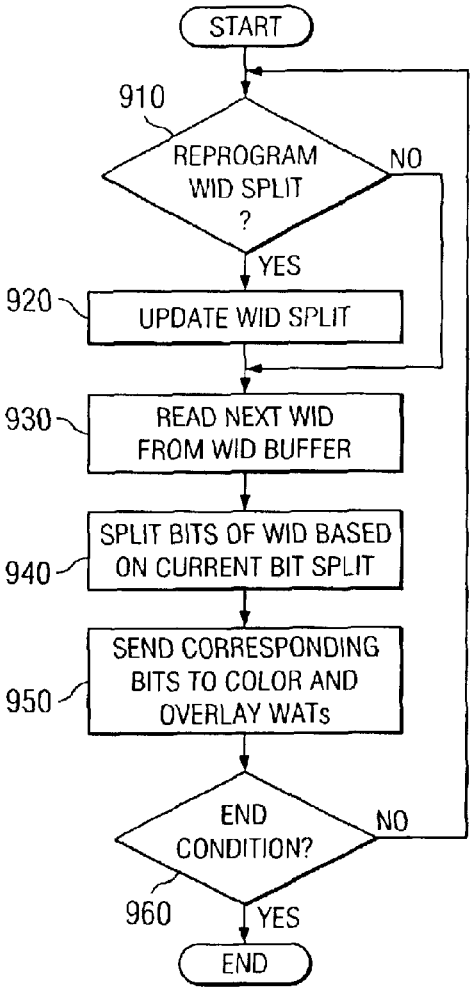
FIG. 9 is a flowchart outlining an exemplary operation of the present invention.

FIG. 9 is a flowchart outlining an exemplary operation of a programmable WAT color selection device in accordance with the present invention. As shown in FIG. 9, the operation starts with a determination as to whether to reprogram the WID split (step 910). This determination may in fact simply be automatic in response to receiving control data from a graphics device driver indicating a new WID split. If so, i.e. if control data is received identifying a new WID split, then the WID split between color and overlay bits is updated (step 920). This may be done, for example, by setting one or more registers in the programmable WAT color selection device identifying the WID split.

Thereafter, or if a control data to reprogram the WID split has not been received, the operation reads the next WID from the WID buffer (step 930). The bits of the WID are then split in accordance with the WID split that is currently in effect (step 940) and the corresponding bits are sent to the color and overlay WAT tables (step 950). Thereafter, a determination is made as to whether an end condition has occurred (step 960), such as shutdown of the computing device, for example. If so, the operation terminates. Otherwise, the operation returns to step 910 and the operation is repeated until an end condition is encountered.

Thus, with the present invention, flexibility in the graphics capabilities of a graphics adapter is obtained by providing a dynamically programmable graphics adapter. More specifically, with the present invention, the number of bits used for color and overlay WAT table indexing is dynamically changeable to obtain varying color and overlay capabilities. Furthermore, this indexing into the WAT tables may be dynamically changeable based on the particular application environment that is currently active.

It is important to note that while the present invention has been described in the context of a fully functioning data processing system, those of ordinary skill in the art will appreciate that the processes of the present invention are capable of being distributed in the form of a computer readable medium of instructions and a variety of forms and that the present invention applies equally regardless of the particular type of signal bearing media actually used to carry out the distribution. Examples of computer readable media include recordable-type media, such as a floppy disk, a hard disk drive, a RAM, CD-ROMs, DVD-ROMs, and transmission-type media, such as digital and analog communications links, wired or wireless communications links using transmission forms, such as, for example, radio frequency and light wave transmissions. The computer readable media may take the form of coded formats that are decoded for actual use in a particular data processing system.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. An apparatus for generating a graphical display on a display device of a computing device, comprising:

a window ID buffer;

a programmable window attribute table color size selection device coupled to the window ID buffer;

a color window attribute table device coupled to the programmable window attribute table color size selection device;

an overlay window attribute table device coupled to the programmable window attribute table color size selection device;

a staged pipeline coupled to the color window attribute table and the overlay window attribute table;

a color buffer coupled to the staged pipeline; and an overlay buffer coupled to the staged pipeline, wherein the programmable window attribute table color size selection device is dynamically programmable based on control data received from a software graphics device driver to thereby change a window ID split from a first window ID split to a second window ID split.

2. The apparatus according to claim 1 further, comprising:

means for receiving control data to set a number of bits of a window ID for indexing into a window attribute table;

means for reading said window ID from said window ID buffer;

means for splitting the window ID into a first set of bits and a second set of bits according to the number of bits for indexing into the window attribute table set based on the control signal; and means for generating the graphical display using al least one entry obtained from at least one window attribute table, wherein the at least one entry is identified by at least one of the first set of bits and the second set of bits.

3. The apparatus of claim 2, wherein the number of bits of a window ID for indexing into a window attribute table is a number of bits of a window ID for indexing into said color window attribute table.

4. The apparatus of claim 2, wherein the means for generating the graphical display using at least one entry obtained from at least one window attribute table includes:

means for sending the first set of bits to said color window attribute table;

means for sending the second set of bits to said overlay window attribute table;

means for obtaining a first entry in the color window attribute table based on the first set of bits being an index into the color window attribute table; and means for obtaining a second entry in the overlay window attribute table based on the second set of bits being an index into the overlay window attribute table.

5. The apparatus of claim 4, further comprising:

means for receiving data from said color buffer;

means for receiving data from said overlay buffer; and means for generating the graphical display based on the data from the color buffer, data from the overlay buffer, the first entry and the second entry.

6. The apparatus of claim 5, wherein the graphical display is generated by a RAMDAC staged pipeline which receives; as input, the data from the color buffer, data from the overlay buffer, the first entry and the second entry.

7. The apparatus of claim 2, wherein the control data is received from a graphics device driver in response to a request from an application to set a window attribute table color size.

8. The apparatus of claim 7, wherein the request is generated by the application upon opening a window of the application.

9. The apparatus of claim 7, wherein the graphics device driver is an XServer device driver.

10. The apparatus of claim 2, further comprising:

means for dynamically setting at least one register identifying a split of the window ID bits, wherein the control data is dynamically received in response to an application requesting a set of graphical parameters to be supported by a graphics adapter.

* * * * *

UNITED STATES PATENT AND TRADEMARK OFFICE

CERTIFICATE OF CORRECTION

PATENT NO. : 6,911,991 B2
APPLICATION NO. : 10/394305
DATED : June 28, 2005
INVENTOR(S) : Marion et al.

It is certified that error appears in the above-identified patent and that said Letters Patent is hereby corrected as shown below:

Col. 9, line 1: after “using” delete “a1” and insert --at--.

Signed and Sealed this

Seventeenth Day of October, 2006

JON W. DUDAS
*Director of the United States Patent and Trademark Office*